United States Patent [19]

Simms

[11] 4,094,541

[45] June 13, 1978

[54] CONCEALED SAFETY LATCH ASSEMBLY

[76] Inventor: Larry Lee Simms, P.O. Box 1083, San Pedro, Calif. 94433

[21] Appl. No.: 775,740

[22] Filed: Mar. 9, 1977

[51] Int. Cl.[2] ..... E05C 3/04

[52] U.S. Cl. ..... 292/231

[58] Field of Search ..... 292/120, 238, 218, 251.5, 292/161, 136, DIG. 38

[56] References Cited

U.S. PATENT DOCUMENTS

| | | | |
|---|---|---|---|
| 790,637 | 5/1905 | Jones | 292/136 |
| 1,830,786 | 11/1931 | Ferris | 292/136 |
| 2,727,650 | 12/1955 | Moynihan et al. | 292/251.5 X |
| 3,155,409 | 11/1964 | Schlissel | 292/251.5 |
| 3,661,413 | 5/1972 | Silva | 292/238 |

FOREIGN PATENT DOCUMENTS

| | | | |
|---|---|---|---|
| 767,818 | 2/1957 | United Kingdom | 292/238 |

*Primary Examiner*—Richard E. Moore
*Attorney, Agent, or Firm*—Charles C. Logan, II

[57] ABSTRACT

A concealed safety latch assembly for a medicine cabinet that has three components: a mounting plate, a latch member, and a locking member. The mounting plate has an aligning flange along its forward edge to facilitate alignment of the mounting plate upon a vertical side wall of the medicine cabinet. The latch member has a nose portion with a cam surface, an unlatching finger, and a notch is formed between them. A tongue member extends into said notch from the body of the latch member and has a reduced thickness adjacent the area where it extends from the body of the latch member. The latch member is pivotally attached to the mounting plate by a shaft passing through an eccentrically located bore on the latch member. The locking member is L-shaped with its vertical leg attached to the inside vertical wall of the medicine cabinet door. The horizontal leg has a forward cammed nose surface behind which a cutaway recess is formed for lockingly engaging the nose of the latch member. The uniqueness of the manner in which the cam surface may be captured between the nose and tongue of the latch member provides a configuration that permits the L-shaped locking member to self-align itself on the back of the medicine cabinet door.

8 Claims, 3 Drawing Figures

CONCEALED SAFETY LATCH ASSEMBLY

BACKGROUND OF THE INVENTION

The invention relates to a door latch assembly and more particularly to a concealed safety latch assembly for a medicine cabinet of the type that is recessed into a bathroom wall. The latch assembly has been designed to be operated easily by adults while remaining basically inoperable by children of substantially five years of age or less.

The problem of small children getting into medicine cabinets and taking drugs that may prove lethal has existed for many years. Numerous attempts have been made to design safety latch assemblies that are child proof. As of yet, none of these have captured the publics acceptance either due to their complicated unlatching structure, their ability to perform as stated, their difficulty in mounting within the medicine cabinet or for various other reasons.

The transformation of our population to a drug and medicine oriented society has placed within the reach of small children, many dangerous pills and drugs that are accessible merely by opening the medicine cabinet door. The simple operation of opening the door is easily accomplished by the youngest of children once they have reached the age where they can crawl or walk. Repeated commands not to open a medicine cabinet door fall on deaf ears for children of this age. The only real way of ensuring that a child will not open a medicine cabinet door and swallow dangerous drugs or medicine is to provide the door with a concealed childproof safety latch. Children are also great imitators and often see their parents taking drugs from the medicine cabinet, not to mention the fact that the parent gives the child proper drugs and pills that are stored within the medicine cabinet.

It is an object of this invention to permit adults to store their drugs and medicines, that are used in day to day use, within their normal medicine cabinet while also providing a sufficient, child-proof safety latch that will prevent accidental access to such drugs and medicine by preschool children.

It is also an object of the invention to provide a new and improved concealed safety latch assembly that is simple and rugged in construction, inexpensive to manufacture, easy to install, and that is efficient in operation.

It is an additional object of the invention to provide a concealed safety latch assembly that may be readily installed in the medicine cabinet in a permanent fashion without the aid of tools and without any but most elemental mechanical skills.

It is a further object of the invention to provide a concealed safety latch assembly that has components that act to align themselves in their operational positions, both on the medicine cabinet door and also on the vertical side wall of the cabinet.

It is a further object of the invention to provide a concealed safety latch assembly that may be easily and quickly placed into inoperable position without the removing of the latch assembly from the cabinet.

SUMMARY OF THE INVENTION

The novel, concealed safety latch assembly is quickly and easily mounted within a standard medicine cabinet. The mounting plate has an aligning flange at its forward edge that allows it to be quickly and properly positioned along the front of the side vertical wall within the medicine cabinet. It is attached thereto by contact adhesive on its back surface. The latch member is pivotally mounted on a shaft extending horizontally from the mounting plate. The latching member has a nose portion with a camming surface and an unlatching finger with a notch formed between them. The latch member has a tongue extending into the notch from the body of the latch member. The locking member is L-shaped in profile and has a vertical leg and a horizontal leg. The vertical leg has contact adhesive on its rear surface for attachment to the inside of the medicine cabinet door. The horizontal leg has a cam surface along its forward edge and a pair of cutaway recesses behind a portion of its cam surface to form a pair of toe members.

After the mounting plate has been secured to the inside wall surface of the medicine cabinet and the latch member has been pivotally mounted on the shaft of the mounting plate, the toe portion of the L-shaped locking member is inserted between the notched portion of the latch member between the tongue and the nose portion. The dimensions of the toe is such that it will be held frictionally engaged while maintaining the verticlal leg substantially parallel to the inside wall of the cabinet door. This allows for easily positioning the L-shaped locking member on the back of the door by merely removing the protective film covering the contact adhesive and closing the cabinet door until the contact adhesive on the vertical leg has contacted and secured itself against the cabinet door.

Next, the plastic card, much in the shape of a credit card is inserted between the space separating the cabinet door from the cabinet itself along the edge of the cabinet door. An upward force is directed against the unfinger that will cause the latch to rotate upwardly causing the tongue member to be fractured at its base where it has its narrowed thickness and snap-off. Continued upward motion against the unlatching finger will disengage the nose of the latch from the recess of the L-shaped locking member and the cabinet door may be easily opened.

A second shaft extending horizontally from the mounting plate functions as a stop member to prevent the latch from dropping below a horizontal orientation. If it is desired to take the safety latch out of operation, one merely flips the latch pivotally upwardly through a rotation of approximately 270° and the latch member will remain inoperative until moved back into its operable position. The use of two symetrically located shafts extending from the mounting plate allows the same mounting plate to be used for either a right or a left handed opening medicine cabinet door.

DESCRIPTION OF THE PREFERRED EMBODIMENT

Figure 2:
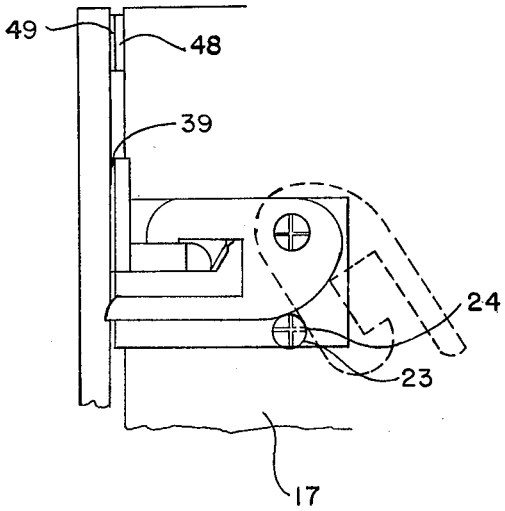
FIG. 2 is a partial, side elevational view of the safety latch assembly mounting with a medicine cabinet.
Figure 3:
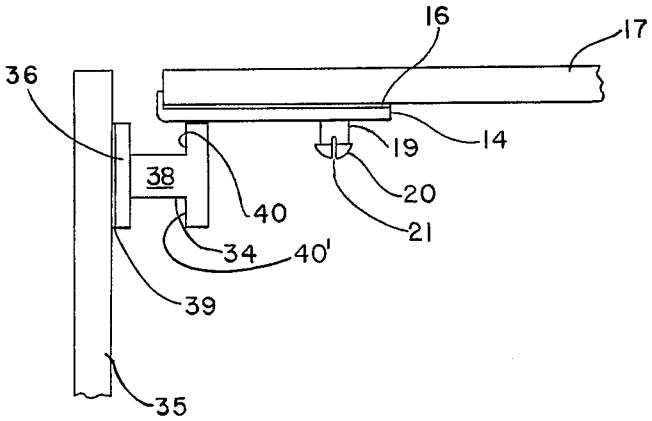
FIG. 3 is a partial top plan view with the latch member removed and illustrating the safety latch assembly mounted within a medicine cabinet.

The novel concealed, safety latch assembly will be described by referring to FIGS. 1-3.

Figure 1:
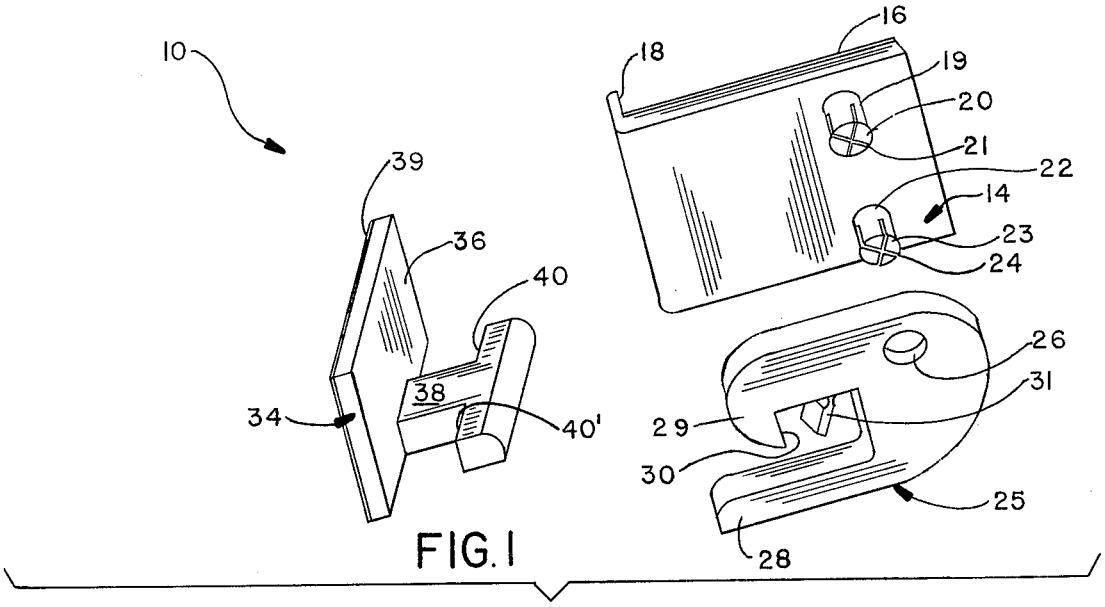
FIG. 1 is an exploded view illustrating the three compnents of the novel safety latch assembly.

In the exploded view illustrated in FIG. 1, the safety latch assembly is generally designated numeral 10. It has three major components: mounting plate 14, latch member 25, and locking member 34 having an L-shaped profile.

Mounting plate 14 has an aligning flange 18 along its forward edge to allow it to self align with the front edge of the vertical wall of a medicine cabinet. Contact adhesive 16 is placed along the rear surface of the mounting plate 14 to mount it to the inside of the vertical wall of the medicine cabinet. A first shaft 19 protrudes outwardly in a horizonal direction from the mounting plate and has a head 20 thereon of a diameter greater than the diameter of the shaft itself. A plurality of slots 21 are cut longitudinally along the shaft 19 for a reason to be discussed later. A second shaft 22 is identical to shaft 19 and it has a head 23 with slots 24. The second shaft performs the function of preventing the latch 25 from dropping below a horizontal orientation and also allows the mounting plate to work with both a right and a left handed opening medicine cabinet door.

The latch member 25 has a nose portion 29 with a camming surface. Latch 25 also has an unlatching finger 28 with a notch 30 formed between these two members. A tongue 31 extends into notch 30 from the body of the latch member and it has a neck of reduced diameter to allow it to be easily snapped off once it has performed its function of aiding in the self alignment of the L-shaped locking member upon the back of the medicine cabinet door. Latch 25 also has a bore 26 into which the head of shaft 19 is inserted. The slots 21 allow the head to contact sufficiently to enter bore 26 and once the head has passes therethrough, it springs outwardly to lock into position. Latch 25 is then pivotally secured to the mounting plate 14. In FIG. 2, the latch member is illustrated resting upon second shaft 22 in its normal operational position and is shown in its out of engagement position by the dashed lines.

L-shaped locking member 34 has a vertical leg 36 and a horizontal leg 38. The forward surface of horizontal leg 38 has a cam surface with cutaway recesses therebehind in the horizonal leg to form toe portions 40 and 40'. The symetrical toe poritons 40 and 40' allow the L-shaped locking meber to be utilized with both a right handed and a left handed opening medicine cabinet door. Contact adhesive 39 is applied to the back of vertical leg 36 for engagement with the back of the medicine cabinet door 35. Elements 48 and 49 are a medal plate and magnet, respectively, that are attached to the inside of the cabinet door and the medicine cabinet.

While in the foregoing there has been shown and described the preferred embodiment of this invention, it is to be understood that minor changes in the details of construction, combination and arrangement of parts, may be resorted to without departing from the spirit and scope of the invention.

What is claimed and desired to be secured by United States Letters Patent is:

1. A concealed safety latch assembly for a cabinet having a hinged door comprising:

a mounting plate for attachment to the wall of a cabinet, a latch member having a nose portion with a cam surface, said latch member also having an unlatching finger with a notch formed between them, a locking member for attachment to the door of a cabinet, said locking member having means for engaging said latch member, and means pivotally attaching said latch means to said mounting plate comprising a shaft extending outwardly from the mounting plate and said latch member has a bore into which said shaft is received, said bore being eccentrically located on said latch member thereby allowing the latch member to be pivoted to a position where it will not be engaged by the locking member when the cabinet door is closed.

2. A concealed safety latch assembly as recited in claim 1 wherein said mounting plate has an aligning flange along its forward edge to allow it to self align with the front edge of the vertical side wall of a cabinet in which the concealed safety latch assembly is to be mounted.

3. A concealed safety latch assembly for a cabinet having a hinged door comprising:

a mounting plate for attachment to the wall of a cabinet, a latch member having a nose portion with a cam surface, said latch member also having an unlatching finger with a notch formed between them, means pivotally attaching said latch means to said mounting plate, a locking member for attachment to the door of a cabinet, said locking member having means for engaging said latch member, and said latch member having a tongue extending from the body of the latch member into the notch formed between the nose portion and the unlatching finger of the latch member, the portion of said notch of the latch member between said nose portion and said tongue functions to capture the means on the locking member for engaging the latch member during the operation of aligning said locking member on a cabinet door.

4. A concealed safety latch assembly as recited in claim 2 further comprising means on the back surface of the mounting plate for attaching to the wall of a cabinet.

5. A concealed safety latch assembly as recited in claim 4 wherein the means on the back surface of the mounting plate is a contact adhesive.

6. A concealed safety latch assembly as recited in claim 3, wherein said tongue has a reduced thickness adjacent the area where it extends from the body of the latch member into said notch thus allowing the tongue to be easily broken off once the locking member has been aligned and attached to a cabinet door by a lifting force against the unlatching finger of the latch member.

7. A concealed safety latch assembly as recited in claim 1, wherein said shaft has a head on it wider than the diameter of the shaft and having at least one slot across its width to allow the head to be compressed enough to be inserted into the bore of said latch member.

8. A concealed safety latch assembly as recited in claim 1, further comprising limiting stop means on said mounting plate for positioning said latch member in proper position to contact and be engaged by said locking member when the door of the cabinet is closed.

* * * * *